US009208768B2

(12) United States Patent
LaCarrubba et al.

(10) Patent No.: US 9,208,768 B2
(45) Date of Patent: Dec. 8, 2015

(54) ACOUSTICAL TRANSVERSE HORN FOR CONTROLLED HORIZONTAL AND VERTICAL SOUND DISPERSION

(71) Applicants: Emanuel LaCarrubba, Novato, CA (US); David Moulton, Groton, MA (US)

(72) Inventors: Emanuel LaCarrubba, Novato, CA (US); David Moulton, Groton, MA (US)

( * ) Notice: Subject to any disclaimer, the term of this patent is extended or adjusted under 35 U.S.C. 154(b) by 302 days.

(21) Appl. No.: 13/661,301

(22) Filed: Oct. 26, 2012

(65) Prior Publication Data

US 2014/0119588 A1 May 1, 2014

(51) Int. Cl.

| | |
|---|---|
| ***H04R 1/20*** | (2006.01) |
| ***G10K 11/02*** | (2006.01) |
| ***G10K 11/28*** | (2006.01) |
| *H04R 1/30* | (2006.01) |
| *H04R 1/34* | (2006.01) |
| *H04R 1/32* | (2006.01) |

(52) U.S. Cl.

CPC ..... *G10K 11/025* (2013.01); *G10K 11/28* (2013.01); *H04R 1/30* (2013.01); *H04R 1/32* (2013.01); *H04R 1/34* (2013.01); *H04R 1/345* (2013.01)

(58) Field of Classification Search

CPC ..... H04R 1/30; H04R 25/48; H04R 1/32; H04R 1/345; H04R 1/34; G10K 11/02; G10K 11/025; G10K 11/26; G10K 11/28

USPC ..... 181/175, 177, 192, 152, 159; 381/339, 381/340, 337

See application file for complete search history.

(56) References Cited

U.S. PATENT DOCUMENTS

| | | | | |
|---|---|---|---|---|
| 1,996,743 | A * | 4/1935 | Blattner | 181/195 |
| 4,310,065 | A * | 1/1982 | Kayman | 181/159 |
| 4,836,329 | A * | 6/1989 | Klayman | 181/155 |
| 5,526,456 | A * | 6/1996 | Heinz | 381/340 |
| 5,615,176 | A | 3/1997 | LaCarrubba | |
| 6,068,080 | A | 5/2000 | LaCarrubba | |
| 6,435,301 | B1 | 8/2002 | LaCarrubba | |
| 6,658,128 | B1 * | 12/2003 | Yoshioka et al. | 381/340 |
| 6,820,718 | B2 | 11/2004 | LaCarrubba | |
| 2003/0228021 | A1 * | 12/2003 | Letinturier et al. | 381/86 |
| 2007/0140508 | A1 | 6/2007 | Soerensen | |

OTHER PUBLICATIONS

International Search Report and Written Opinion dated Aug. 11, 2014 in International Patent Application No. PCT/US2013/066779.

* cited by examiner

*Primary Examiner* — Davetta W Goins
*Assistant Examiner* — Oyesola C Ojo
(74) *Attorney, Agent, or Firm* — Vierra Magen Marcus LLP

(57) ABSTRACT

An acoustical horn is disclosed which is configured to redirect spherical acoustic wave fronts radiated from a transducer with a minimum amount of distortion. The acoustical horn includes top and bottom portion which are asymmetrically-shaped with respect to each other.

25 Claims, 13 Drawing Sheets

ACOUSTICAL TRANSVERSE HORN FOR CONTROLLED HORIZONTAL AND VERTICAL SOUND DISPERSION

BACKGROUND

In designing loudspeaker systems, two important concerns are the vertical and horizontal directivity of sound radiation from the system. For example, a certain class of acoustical horn is known for taking acoustic power from a vertically oriented transducer and redistributing that power in a generally wide horizontal pattern, where it is most useful, i.e., to the ears of a listening audience in front and horizontally to the sides of the loudspeaker system. Redistribution of acoustic power in this manner comes at the expense of distortion due to deformation of the spherical wave front that is initially generated by the transducer. It is a goal of acoustical horns to provide optimal directivity of acoustic power with a minimum of distortion over the desired spectrum of acoustic wavelengths.

The design of this type of acoustical horn has been driven by a ray-tracing paradigm. The prior art shows that designers have treated acoustic power as emitting from the transducer as a plurality of linear rays, and the design of these acoustical horns has been based on providing desired directivities to these linear rays. As one example, U.S. Pat. No. 4,836,329 to Klayman teaches an acoustical horn including concave and convex conical sections defined by sweeping a single line segment 180° with the axis of rotation lying midway along the line segment. The design is intended to operate so that any "ray" of acoustic power emitting from the transducer proceeds in a straight line until contact with a surface of the horn, at which point the ray is redirected based on its angle of incidence in a straight line out of the horn.

One consequence of this in prior designs was rigid constraints on the geometry of the horn and its surfaces. This reduced the ability of horn designers to customize the horn for different uses and for different transducers, for example a compression driver versus as domed tweeter.

It has been determined that treatment of acoustic power from common transducers as a set of linear rays traveling through air is fundamentally flawed, as well as conceptually misleading. Acoustic power in fact emits from a transducer in spherical waves, which expand in a sphere outward from the transducer into the surrounding environment. Given this recognition, there is a need to reconsider the approach to designing an acoustical horn with reflective surfaces of this type (Klayman et al), optimally suited to shape and direct spherical waves as opposed to rays.

DETAILED DESCRIPTION

Embodiments will now be described with reference to FIGS. 1 through 12, which in general relate to an acoustical horn for directing acoustic power from a transducer in a desired pattern to the environment surrounding the horn. It is understood that the present invention may be embodied in many different forms and should not be construed as being limited to the embodiments set forth herein. Rather, these embodiments are provided so that this disclosure will be thorough and complete and will fully convey the invention to those skilled in the art. Indeed, the invention is intended to cover alternatives, modifications and equivalents of these embodiments, which are included within the scope and spirit of the invention as defined by the appended claims. Furthermore, in the following detailed description of the present invention, numerous specific details are set forth in order to provide a thorough understanding of the present invention. However, it will be clear to those of ordinary skill in the art that the present invention may be practiced without such specific details.

The terms "top" and "bottom," "upper" and "lower" and "vertical" and "horizontal" as may be used herein are for convenience and illustrative purposes only, and are not meant to limit the description of the invention inasmuch as the referenced item can be exchanged in position. As one example, a "bottom" portion of an acoustical horn may be described below as being affixed on top of an upwardly facing transducer. However, the bottom portion may in embodiments be the uppermost surface of the horn, for example where the horn is affixed beneath a speaker which faces downward.

In embodiments, the acoustical horn of the present technology includes a top portion, a back portion and a bottom portion working in concert for shaping acoustic power which may emit from a transducer in spherical waves. In accordance with one feature of the present technology, the acoustical horn is vertically asymmetric, which as used herein implies that the top portion has a different shape than the bottom portion. The top, back and bottom portions further include contours for shaping and providing directivity to acoustic power radiating from the acoustical horn. These contours allow re-direction of the acoustic power while minimizing the distortion inherent in acoustical horns of this type. Embodiments of the different portions, contours and features of the acoustical horn are explained below.

Figure 1:
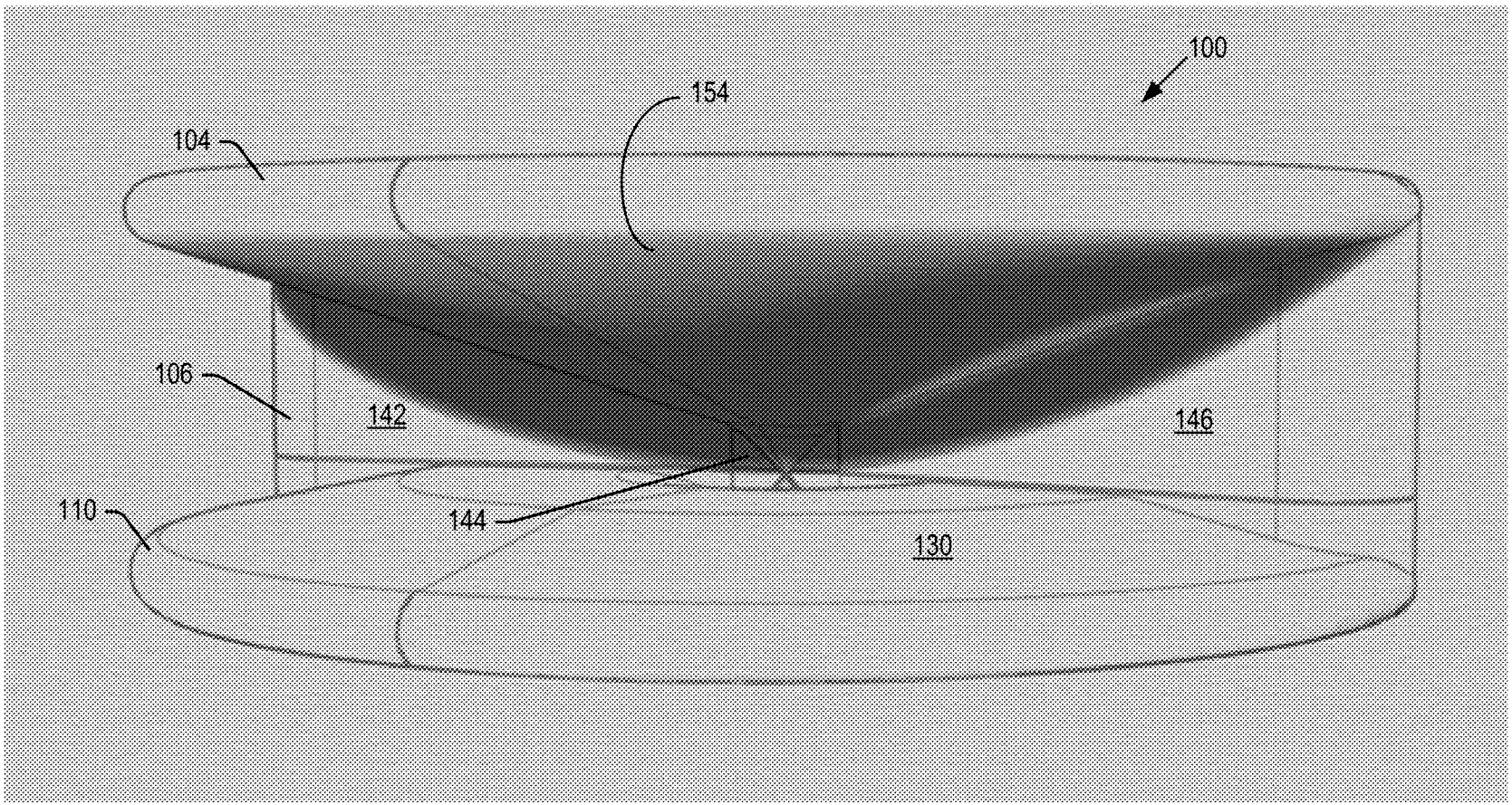
FIG. 1 is a front perspective view of an acoustical horn according to embodiments of the present disclosure.
Figure 8:
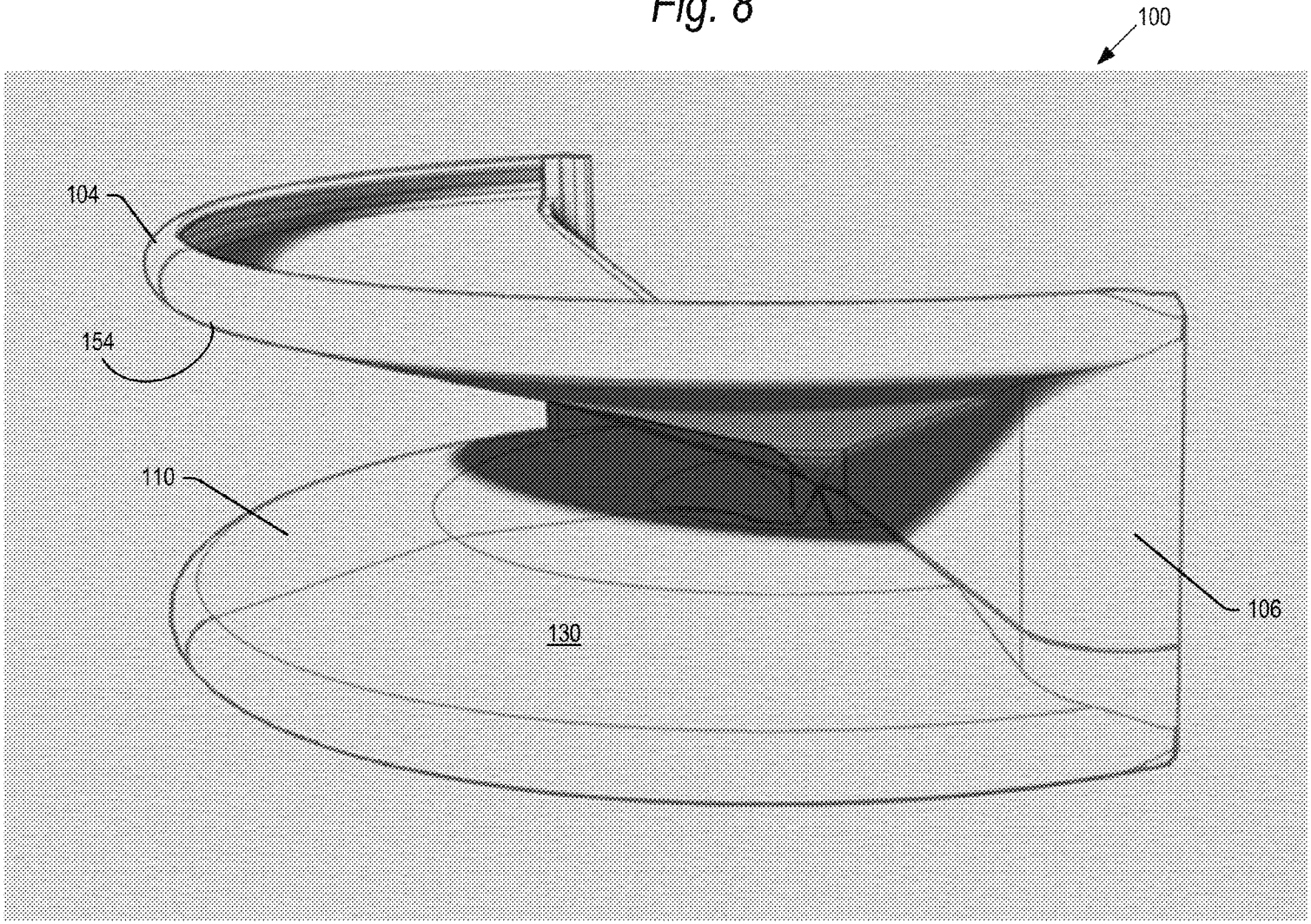
FIG. 8 is a further elevated front/side perspective view of an acoustical horn according to embodiments of the present disclosure.

As seen, for example, in FIGS. 1 and 8, an acoustical horn 100 may include a top portion 104 and a bottom portion 110, which may be separated and connected by a back portion 106. The top, back and bottom portions may be injection molded as a single component. Alternatively, they may be separately manufactured and affixed to each other by known affixation means.

Figure 5A:
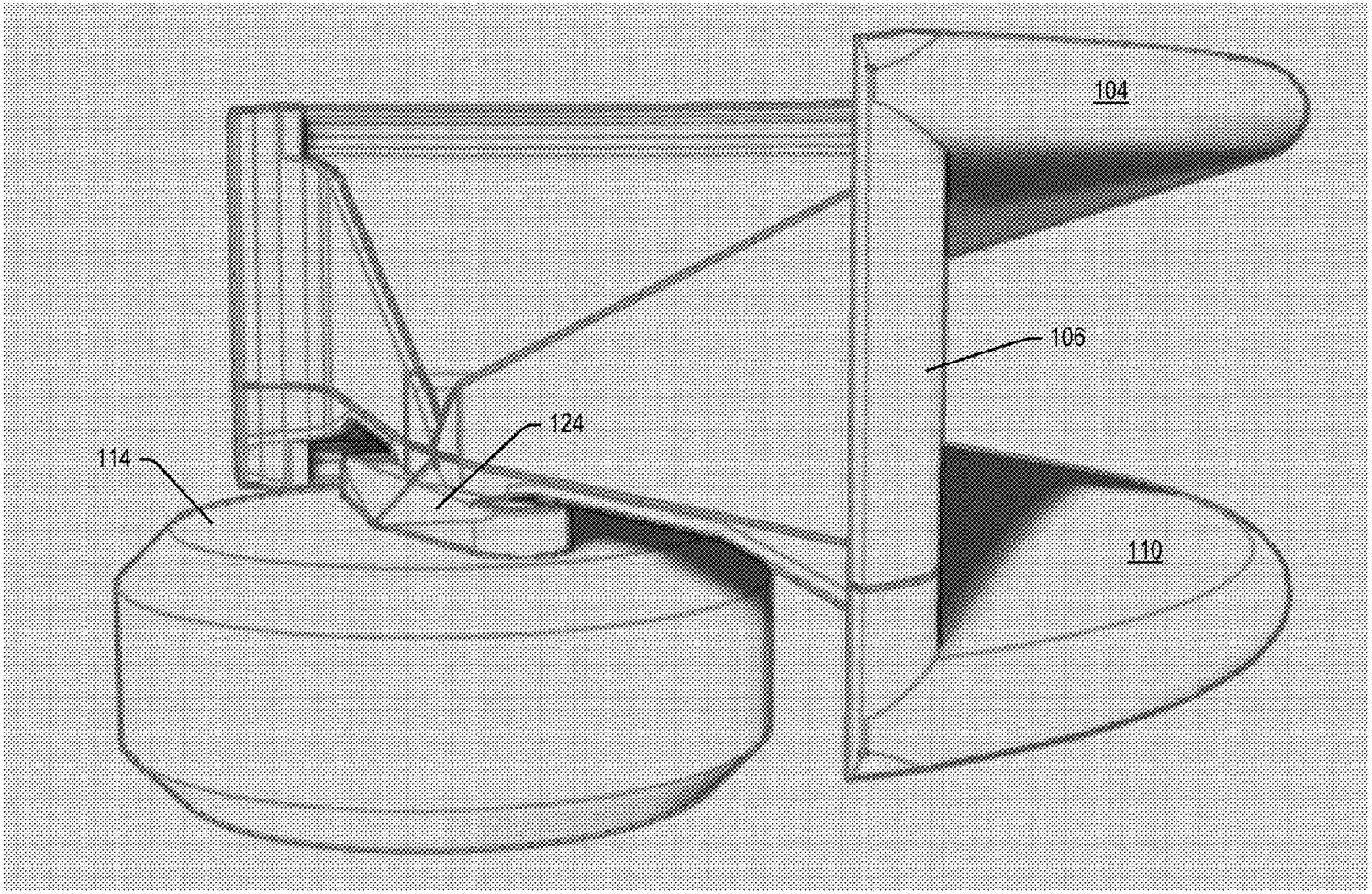
FIG. 5A is a bottom perspective view of an acoustical horn affixed to a transducer according to embodiments of the present disclosure.
Figure 5B:
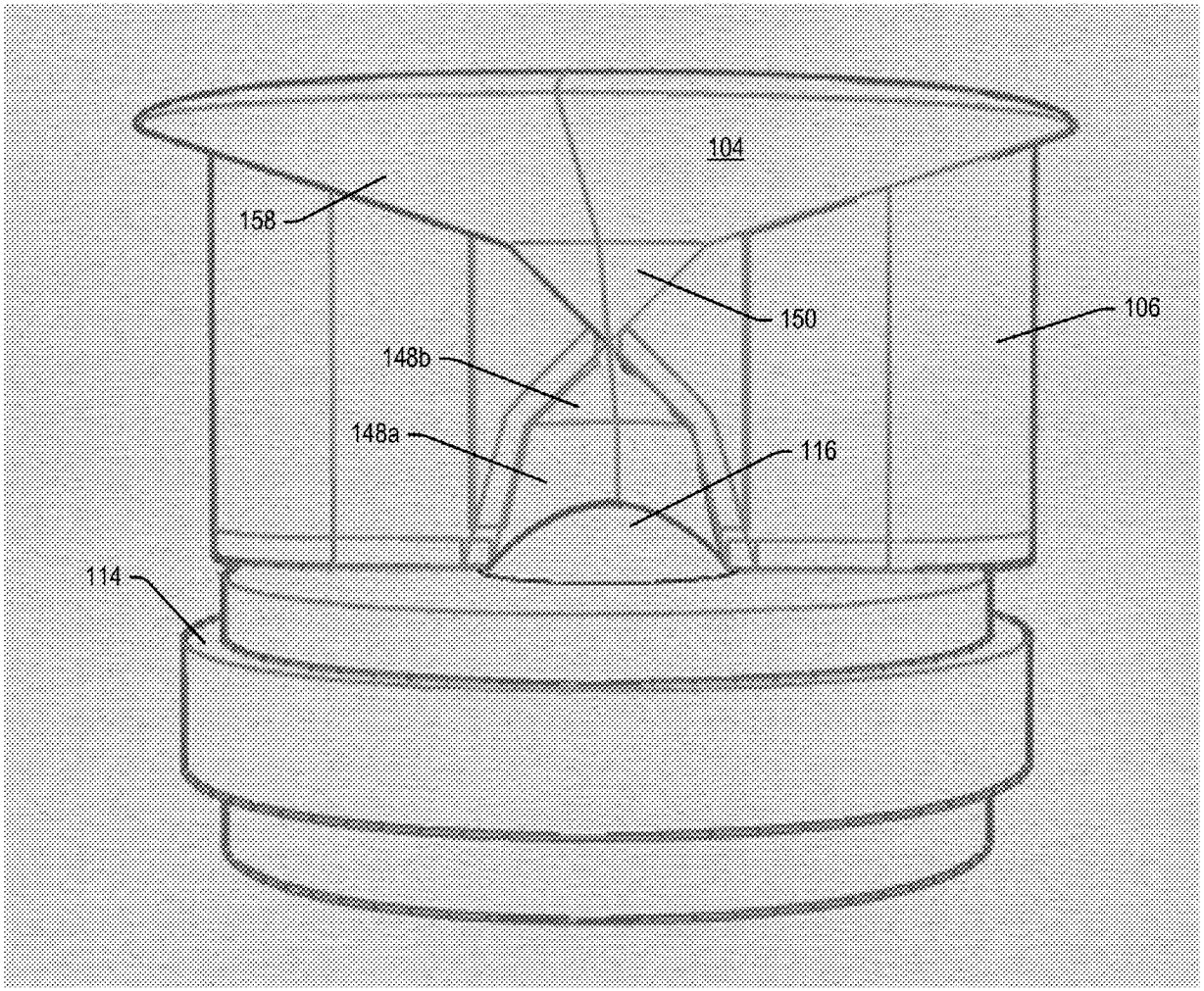
FIG. 5B is a front perspective view of an acoustical horn affixed to an alternative transducer according to embodiments of the present disclosure.

Bottom portion 110 may be affixed to a transducer 114, examples of which are seen in the rear view of FIG. 5A and the front view of FIG. 5B. The transducer 114 of FIG. 5A may be a compression driver, and the transducer 114 of FIG. 5B may be a dome tweeter (the bottom portion 110 is omitted from FIG. 5B for clarity). However, the type of transducer 114 used is not critical to the present disclosure, and transducer 114 may be variety of other acoustic power sources.

Figure 2:
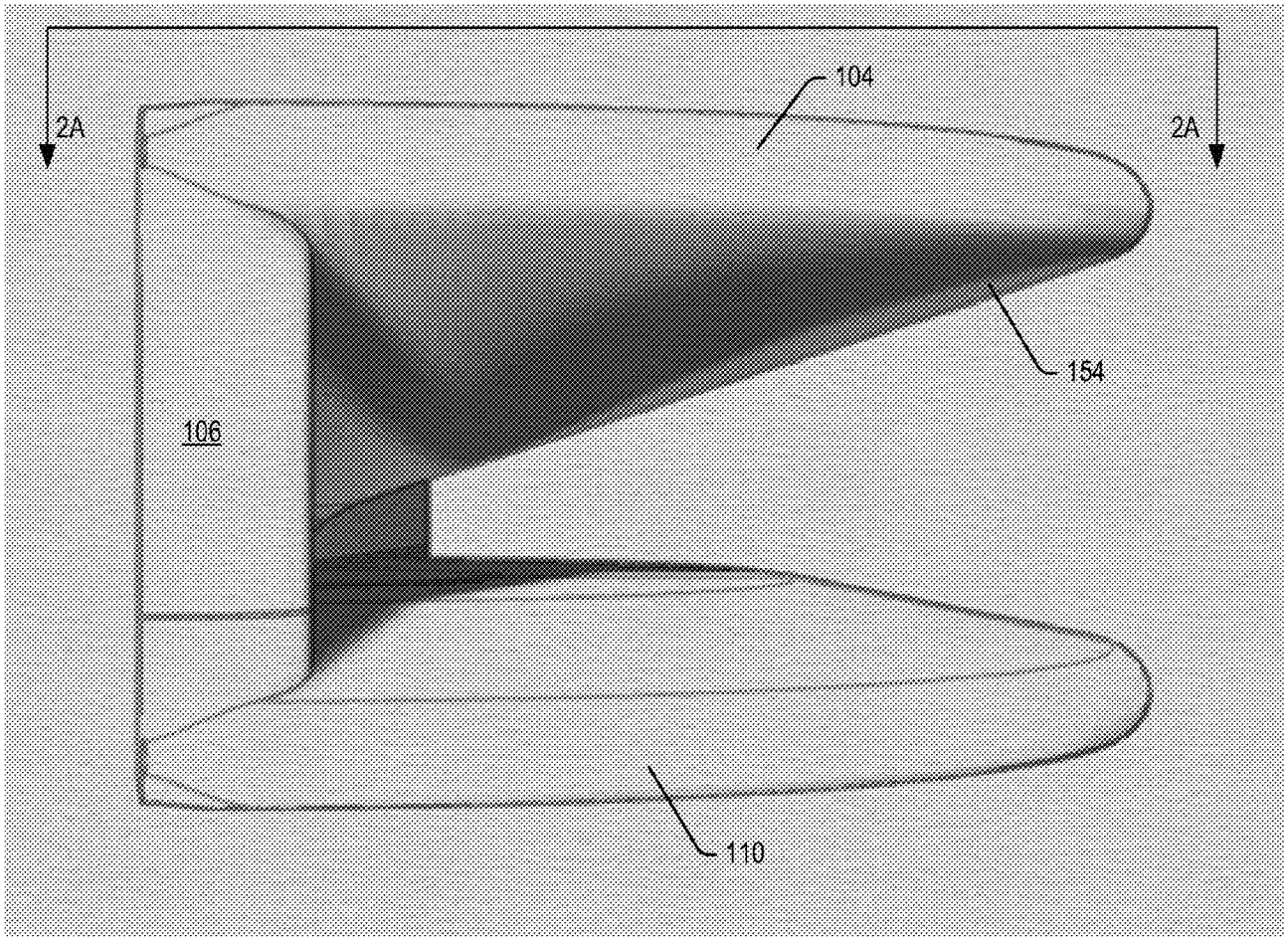
FIG. 2 is a side view of an acoustical horn according to embodiments of the present disclosure.
Figure 2A:
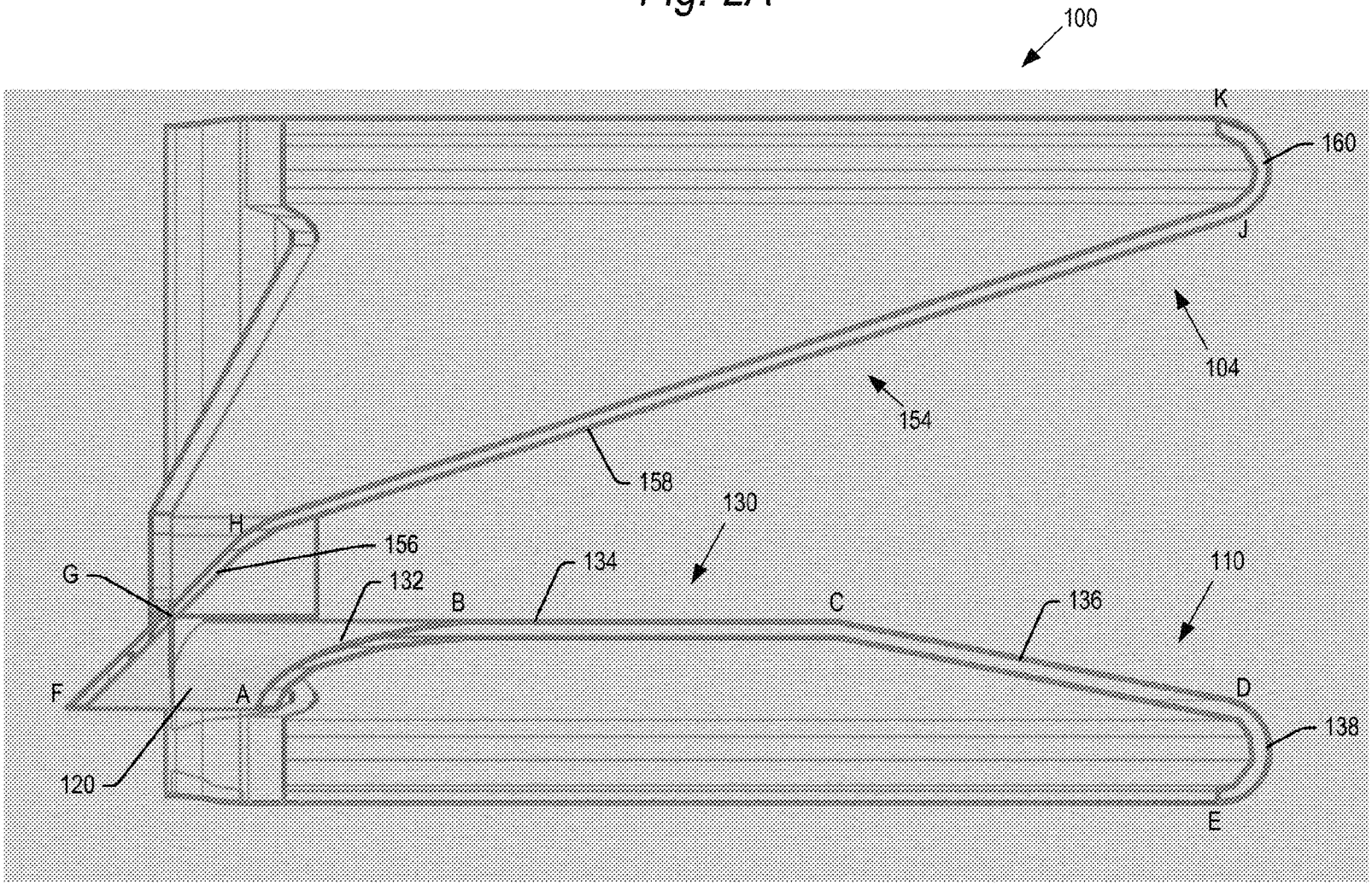
FIG. 2A is a cross-sectional view through line 2A-2A of FIG. 2 forming a vertical bisection of the horn, the bisection passing through a center of the throat of the horn.
Figure 3:
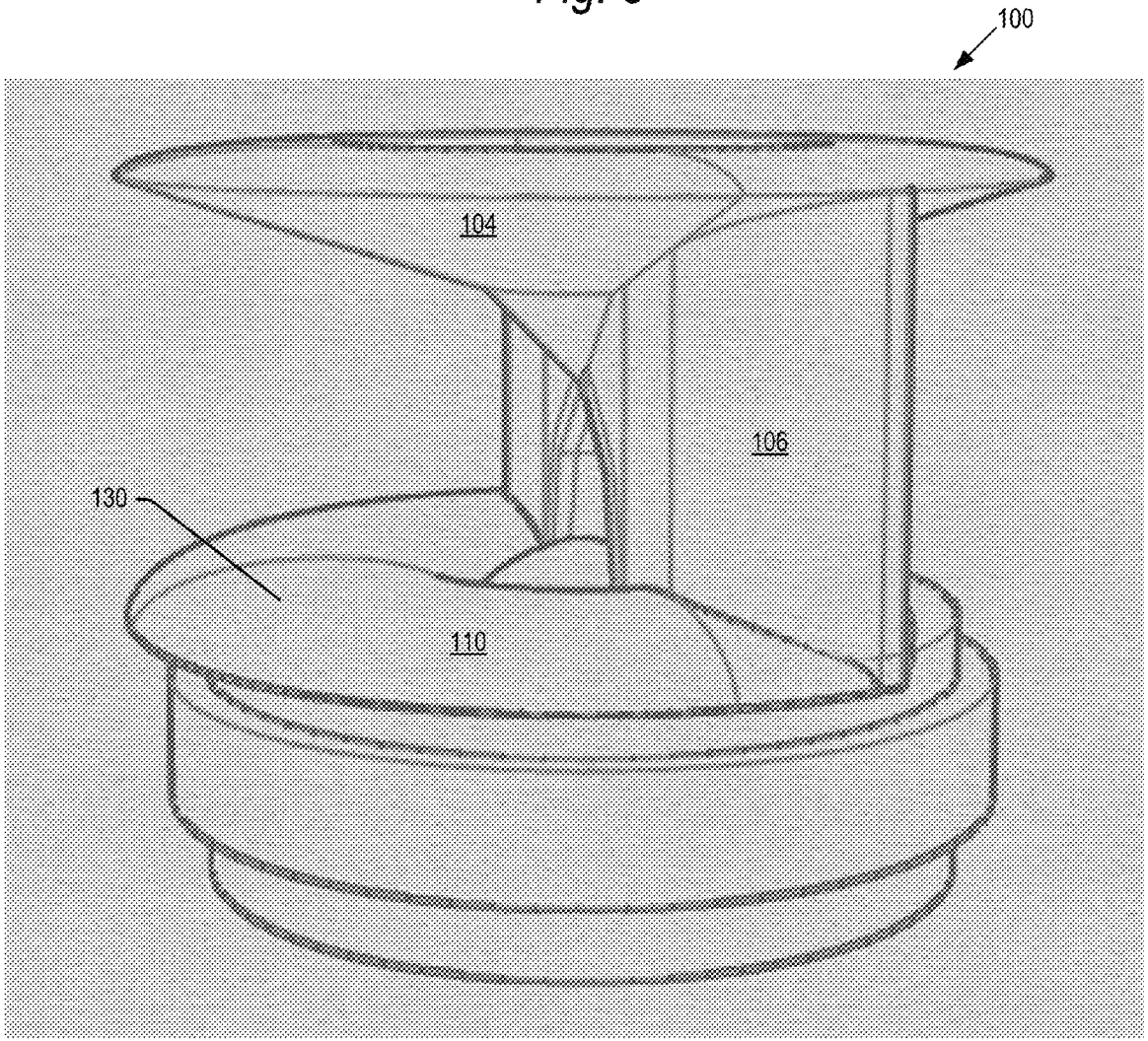
FIG. 3 is a front perspective view of a horn including an alternative bottom portion according to embodiments of the present disclosure.
Figure 4:
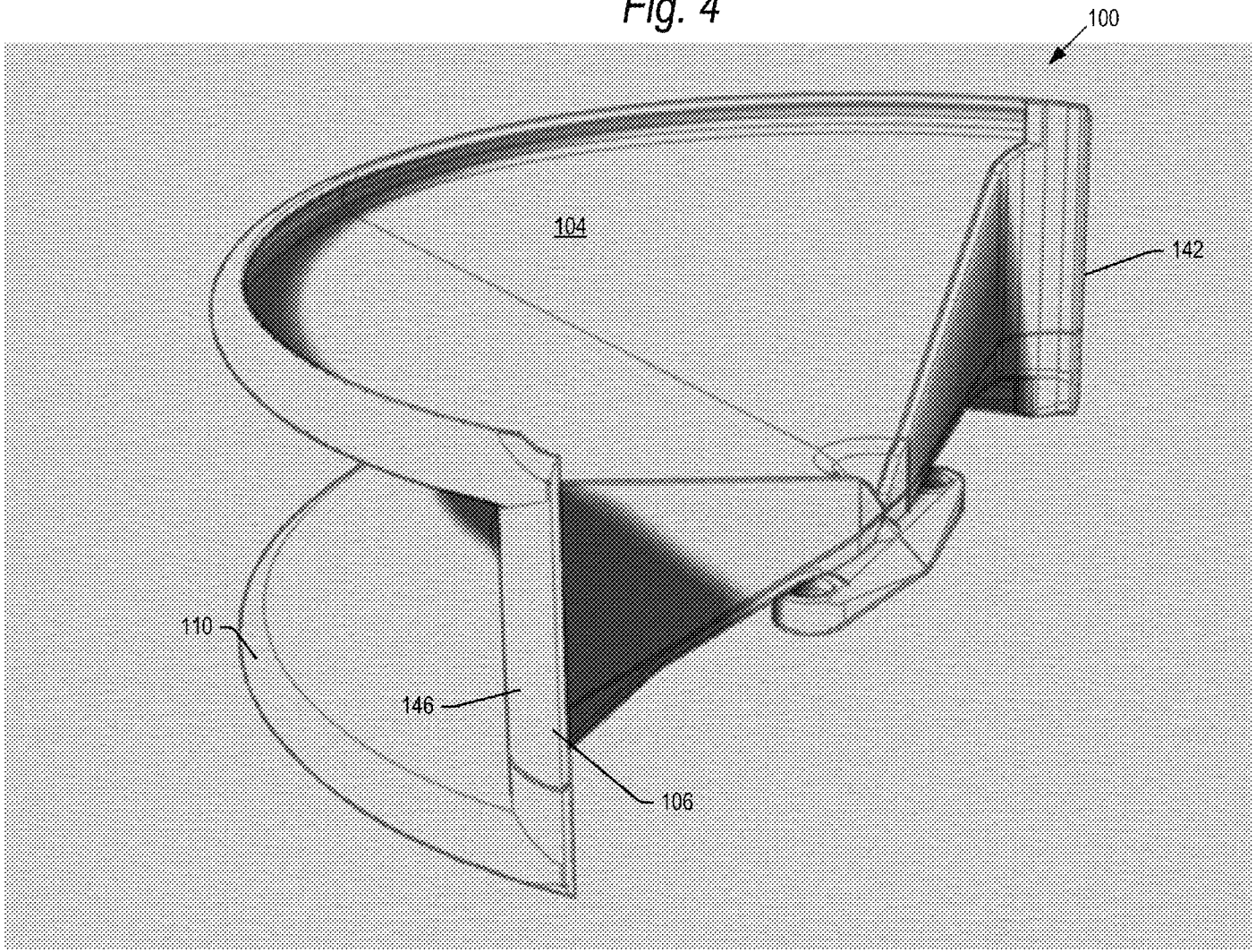
FIG. 4 is a top perspective view of an acoustical horn according to embodiments of the present disclosure.
Figure 6:
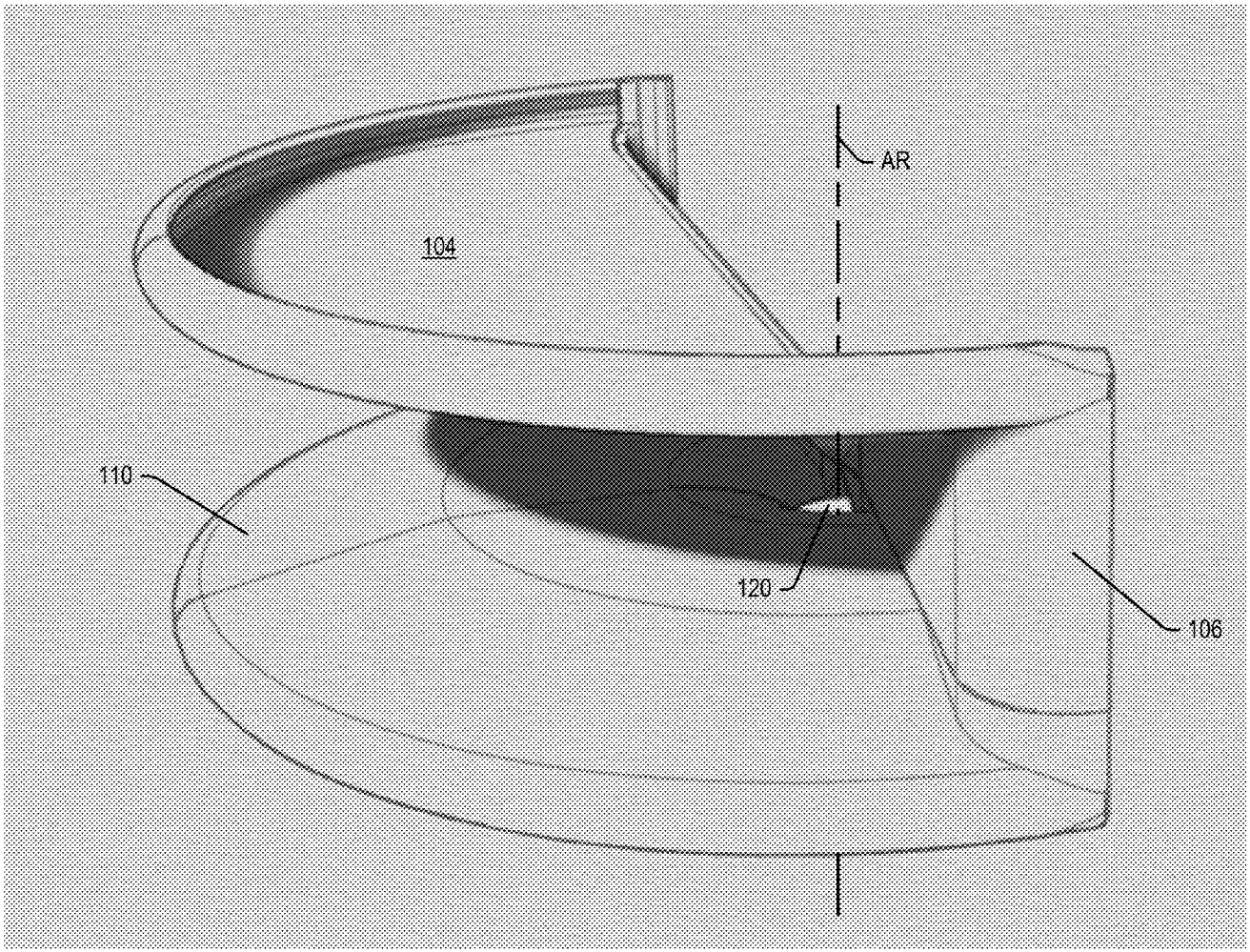
FIG. 6 is an elevated side perspective view of an acoustical horn according to embodiments of the present disclosure.
Figure 7:
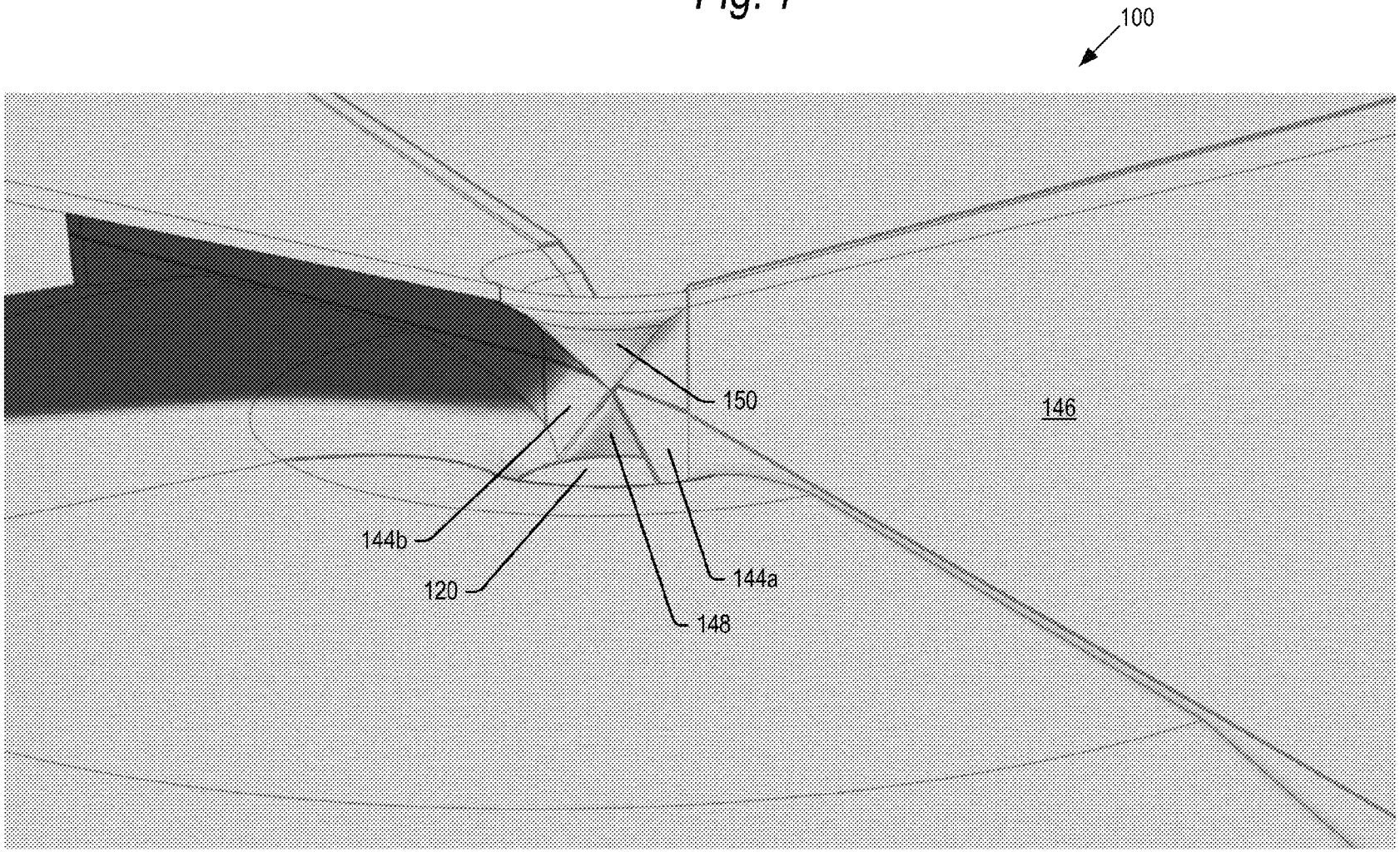
FIG. 7 is an enlarged perspective view of a portion of an acoustical horn, with a large section of the top portion removed for clarity, according to embodiments of the present disclosure.

The bottom portion 110 of horn 100 may affix to the transducer 114, aligned over a throat 120 (seen for example in FIGS. 2A, 6 and 7). The throat of the horn 100 is the space within the horn that is immediately proximate to the output area of the transducer. Fastening may be accomplished by fasteners affixed within a bracket 124 formed in the bottom portion 110 to fix the position of the horn 100 relative to the transducer 114. In embodiments, throat 120 may have a diameter of between 1 and 2 inches, though it may be larger or smaller than that in further embodiments. The horn 100 may be affixed to the transducer 114 by a variety of other fastening schemes in further embodiments, and may alternatively be formed integrally with transducer 114.

As explained below, it is a feature of the present disclosure that the geometry of the horn 100 is not constrained as in prior art designs, and may be altered to optimize its performance with different transducers. For example, the compression driver of FIG. 5A has only an opening which aligns with the throat 120 (FIGS. 2A, 6 and 7). By contrast, the dome tweeter of FIG. 5B has a dome 116 which protrudes up into the throat 120. Given the different constructions of these transducers, the shape of a concave conical section 148 (discussed below) in the horn 100 may be altered to optimize the horn 100 for a compression driver or a dome tweeter. The concave conical section 148 used with a compression driver may be as shown in FIGS. 2A, 6 and 7. The concave conical section 148 used with a dome tweeter may be elongated by comparison, and broken into two discontinuous conic sections 148*a* and 148*b*, as shown in FIG. 5B.

Referring now to FIGS. 1, 2, 2A, 5, 6, 7 and 8, the bottom portion 110 includes a surface 130 facing an interior of the horn 100. As seen for example in FIG. 1, the surface 130 may be defined by an irregular-shaped line segment, having an axis of rotation AR (FIG. 6) at the center of the throat 120, being swept through a given arc. As explained below, in embodiments, that arc may typically be between 140° and 180°. The number of degrees of rotation of surface 130 may match that of a surface 154 (explained below) in top portion 104.

The irregular-shaped line segment defining the surface 130 may be designated as line segment ABCDE as shown in the cross-sectional view of FIG. 2A. A first surface 132 may have either an exponentially or similarly flared convex shape, or a flat surface, starting at point A at the throat 120 and ending at point B. As noted in the Background section, acoustic power emits from the transducer 114 in an expanding spherical wave. By providing an appropriate expanding shape, to the first surface 132, spherical waves may expand more naturally between the surface 132 on the lower surface 130 and a surface 154 on the top portion 104 (explained below) with significantly reduced distortion in comparison to other acoustical horns of this type. The length of segment AB may be between 10% to 30% of the length of segment ABCD, though it may be a greater percentage or a smaller percentage in further embodiments. The specifics of all of the segments and surfaces that make up the horn may be varied to be optimized to suit a given transducer and the designer's needs for the acoustical output of the horn/transducer combination.

A second surface 134 has a generally planar, horizontal shape, starting at point B and ending at point C. This surface, together with the surface 154 in the top portion 104 allows the spherical waves of radiating acoustic power to continue to expand in a controlled manner to suit the designer's requirements while mitigating distortion. The length of segment BC may be between 30% to 50% of the length of segment ABCD, though it may be a greater percentage or a smaller percentage in further embodiments. In embodiments, section BC may be omitted altogether so that surface 132 goes directly into surface 136 described below.

A third surface 136 has a generally planar, sloped shape, starting at point C and ending at point D. Surface 136 may extend at an oblique angle from surface 134. In examples, the angle may range from 10° to 30°, though it may be lesser or greater than that in further embodiments. It is conceivable that the angle be zero degrees so that surface 136 is a continuous extension of surface 134. It has been learned that substantially horizontal surfaces implemented in this manner tend to distort expanding spherical acoustic waves. Providing a downward slope to the third surface 136 both allows expansion of the spherical wave and allows the spherical waves to radiate with less distortion. The length of segment CD may be between 30% to 50% of the length of segment ABCD, though it may be a greater percentage or a smaller percentage in further embodiments.

In embodiments described above, surface 130 is defined by four discontinuous line segments which are revolved to define surface 130, to form four differentiated conic surfaces. In further embodiments, surface 130 may include more or less differentiated surfaces. In one such further embodiment shown in FIG. 3, the surface 130 may be a continuous curve (i.e., having no differentiated surfaces). This provides a more appropriate vertical output radiation for a consumer loudspeaker as opposed to the much larger sound reinforcement horn shown in embodiments of the figures. As described below, the horn 100 may be optimized for a variety of applications. As the horn shrinks in size, as would be more appropriate for a consumer speaker, the differentiated segments may be omitted in favor of a continuous surface 130, as the differentiated segments may become too small compared to the acoustical wavelengths to be meaningful. As this points out, it may be desirable to vary the geometry to optimize the horn at different sizes and scales.

Surface 130 further includes a fourth surface 138 extending from point D to point E to define a curved lip at the outer edge of the horn 100. The outer perimeter of horn 100 may be referred to herein as the mouth of the horn 100. It has been learned that an abrupt edge in the mouth of an acoustical horn may cause distortion in sound waves emitted from the horn. Providing a rounded lip at fourth surface 138 allows radiation of the acoustic power from horn 100 with reduced distortion. The horn 100 may have a sharp edge at the mouth on bottom portion 110 and/or top portion 104 in further embodiments.

Referring now to FIGS. 1, 4, 7 and 8, the back portion 106 includes generally planar surfaces 142, 144 and 146 facing interiorly of the horn 100, and extending generally perpendicularly upward from surface 130 of bottom portion 110. If the horn 100 were bisected into equal halves by a plane down through the top portion 104 and through the center of throat 120, the planar surface 144 may be perpendicular to such a bisecting plane. A plane including the surface 144 itself may go through a center point of throat 120, though it need not intersect the center point in further embodiments.

FIG. 7 is an enlarged view with a large section of top portion 104 removed for clarity. As indicated in FIG. 7, in embodiments, surface 144 may have a shape comprised of two planar, generally triangular sections 144*a*, 144*b*. One edge of triangular section 144*a* defines a boundary between surface 144 and surface 146. A second side of the generally triangular section is defined by a boundary with a concave conical section 148, and a third side of the generally triangular section is defined by a boundary with a convex conical section 150. Concave and convex conical sections 148, 150 are described below.

One edge of triangular section 144*b* defines a boundary between surface 144 and surface 142. A second side of the generally triangular section is defined by a boundary with the concave conical section 148, and a third side of the generally triangular section is defined by a boundary with the convex conical section 150. The size and shape of conical sections 148, 150 may define the width (between surfaces 142 and 146) and a height of planar surface 144.

Planar surfaces 142 and 146 extend from opposite sides of planar surface 144. Lower edges of surfaces 142, 146 are defined by the line segment ABCDE in lower surface 130, discussed above. Upper edges are defined by line segments FGHJK in upper surface 154, discussed below. As seen for example in FIG. 1, the height of surfaces 142, 146 increases radially outward from throat 120 to accommodate the expanding acoustical spherical waves with reduced distortion. As indicated, for example, in FIGS. 4 and 8, outer edges of the surfaces 142 and 144 at the mouth of horn 100 may include a rounded lip. As indicated above, rounding the edges at the mouth avoids distortion which may otherwise occur with sound waves exiting a horn at an abrupt edge.

The directivity of the radiated acoustic waves may also be controlled by angling surfaces 142, 146 inward relative to surface 144. As indicated for example in FIG. 4, each surface 142, 146 may angle inward between 10° and 20° in an example, to provide an arc length of horn 100 of between 140° and 160°. In a further example, each surface 142, 146 may angle inward between 5° and 30°, to provide an arc length of horn 100 of between 120° and 170°. The angle of each surface 142, 144 may vary above or below these ranges in further embodiments. In embodiments, surfaces 142, 144 angle inward the same degree as each other, though they need not in further embodiments. The angling of surfaces 142, 146 inward, or outward, primarily controls the horizontal radiation characteristics of the horn 100.

Certain surfaces such as concave conical section 148 and convex conical section 150 have been described as being part of the back portion 106. However, this is by way of example only, and it is understood that one or more of the surfaces described above as being part of the back portion 106 may instead be considered as being part of the top portion 104 and/or bottom portion 110. For example, as explained below, concave conical section 148 and/or convex conical section 150 may be considered as part of the top portion 104.

Referring now to FIGS. 1, 2, 2A, 7 and 8, the top portion 104 may include a surface 154 facing an interior of the horn 100. As seen, for example, in FIG. 1, the surface 154 may be defined by a pair of line segments, having an axis of rotation over the throat 120, being swept through a given arc. As explained above, in embodiments, that arc may be typically between 140° and 180°.

The line segment defining the surface 154 may be designated as line segment FGHJK as shown in the cross-sectional view of FIG. 2A. Line segment FGHJK may have an axis of rotation about point G. Point G may be centered along the axis AR over a center of throat 120, though point G need not be centered over a center of throat 120 in further embodiments. Given rotation about point G, when the line segment FGHJK is swept, portion FG of the line segment defines the concave conical section 148 seen, for example, in FIG. 7, and portion GH of the line segment defines the convex conical section 150.

Line segment FGH may be a straight line defining a surface 156. Surface 156 may form an angle of approximately 45° to 60° with the horizontal, though the angle may be more or less than that in further embodiments. The ratio of lengths of line segment FG to GH may be approximately 1:1, so that the concave conical section 148 is generally the same size as convex conical section 150. However, one of segments FG or GH may be longer than the other by approximately 20% or more in further embodiments.

Line segment HJ may be a straight line defining a surface 158. Surface 158 may extend obliquely from the surface 156 an angle of approximately 15° to 30° with the horizontal, though the angle may be more or less than that in further embodiments. The ratio of line segment FGH to HJ may be approximately 1:5, though the ratio may be larger or smaller in further embodiments. Providing surface 156 with a less acute angle than the surface 158 provides the redirection of the acoustic power radiating from the throat 120. The transition between surfaces 156 and 158 may be rounded to prevent distortion due to a discontinuous transition.

As explained below, parameters within the horn 100 may be varied to achieve different results for different applications. As one example, the ratio of the lengths and the relative angles of surfaces 156 and 158 to each other may be purposefully varied, depending on the application for which horn 100 is to be used. The ratio may be decreased (the line segment FGH made larger relative to line segment HJ) depending on the frequency range and vertical directivity coverage that is being controlled. For example, the ratio may be decreased to increase the vertical directivity of the horn 100.

Surface 154 is described above as including a single continuous surface 158, or two continuous surfaces 156 and 158 that are discontinuous to each other. In further embodiments, surface 154 may include additional discontinuous surfaces, analogous to the discontinuous surfaces in the bottom portion 110 described above. One such example is shown in FIG. 5B, which includes a first (concave) conic surface 148*a*, a second (concave) conic surface 148*b*, a third (convex) conic surface 150 and a fourth (convex) conic surface 158. Surfaces 148*b* and 150 are formed by revolving a single continuous (straight) line segment. Surface 148*a* is formed by revolving a second line segment that is discontinuous with the line segment of surfaces 148*b* and 150. Surface 158 is formed by a revolving a third line segment that is discontinuous with the line segment of surfaces 148*b* and 150. In further examples, surface 158 may be divided into two or more discontinuous conic sections, as shown by conic surfaces 158*a* and 158*b* in FIG. 12 (the bottom portion 110 is omitted from FIG. 12 for clarity). As used herein, discontinuous may refer to surfaces which are contiguous and extend from each other, but extend from each other at a non-zero angle (i.e., the contiguous surfaces are not parallel to each other).

The portion of surface 154 defined in segment JK provides a curved lip 160 at the mouth of the horn 100. As noted above, providing a rounded lip at the mouth of horn 100 allows radiation of the acoustic power from horn 100 with reduced distortion.

According to an aspect of the present technology, the top portion 104 and the bottom portion 110 work together to shape the acoustic output in a manner not found in prior art acoustical horn designs. Given the recognition that acoustic energy from traditional transducers radiates in spherical waves instead of planar rays, the top and bottom portions 104, 110 cooperate to allow natural expansion of the wave, while at the same time providing the desired directional characteristics. Acoustic waves radiating from the throat initially encounter the first surface 132 of the bottom portion 110 and the surface 156 of the top portion 104. The distance between these initially-encountered surfaces of the horn 100 increase radially out from throat 120 to allow natural expansion of the spherical acoustic wave. This allows for aggressive redirection of the acoustic output of the transducer to provide the desired output radiation pattern while mitigating distortion.

Acoustic waves next encounter the planar surface 134 of bottom portion 110 and surface 158 of the top portion 104. These surfaces together impart vertical directivity control to the acoustic wave, but as the space between those surfaces continues to increase, the wavefront integrity is substantially maintained. Acoustic waves next encounter the downwardly sloped surface 136 in the bottom portion while still travelling along the surface 158 in the top portion 104. These surfaces slope away from each other to allow further expansion of the acoustic wave to minimize distortion of the wavefront. Finally, the mouth of the horn at the top and bottom portions 104, 110 includes curved lips which provide a smooth transition of the wave into the surrounding environment, again, minimizing distortion. Thus, in this described example, the top and bottom portions 104, 110 cooperate to redirect and shape acoustic waves to provide a desired degree of horizontal and vertical directivity while minimizing distortion.

In prior art acoustical horns, for example those designed based on the ray-tracing paradigm discussed in the Background section, directivity control was achieved in part by providing a strict and rigid definition to the geometry of the interior surfaces. For example, in order to achieve horizontal directivity of rays emanating from a transducer, one example of a prior art acoustical horn, or reflector as they are sometimes called, used a portion of an ellipse, having an axis of rotation over the throat and being swept through a 180° arc. A shape defined in this manner, by definition, has rigid geometric constraints. The prior art describes rays that emanate from one elliptical focal point that pass through the other focal point of the ellipse, and then horizontally out of the device. Designs based on such ray-tracing models also used rotated straight line sections from the throat to the mouth, and rotated parabolic sections. A common feature to all of these designs was a need for all surfaces within the horn to be defined with rigid mathematical geometric constraints, both with respect to each other and as a whole.

Figure 10:
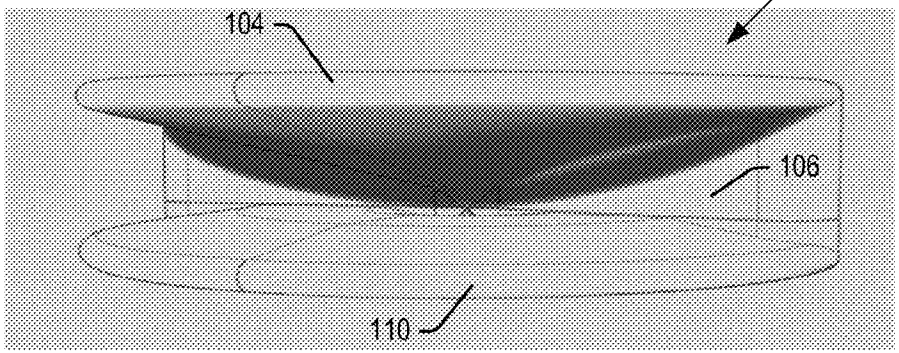
FIGS. 9 and 10 are front perspective views of acoustical horns of different aspect ratios according to embodiments of the present disclosure.
Figure 9:
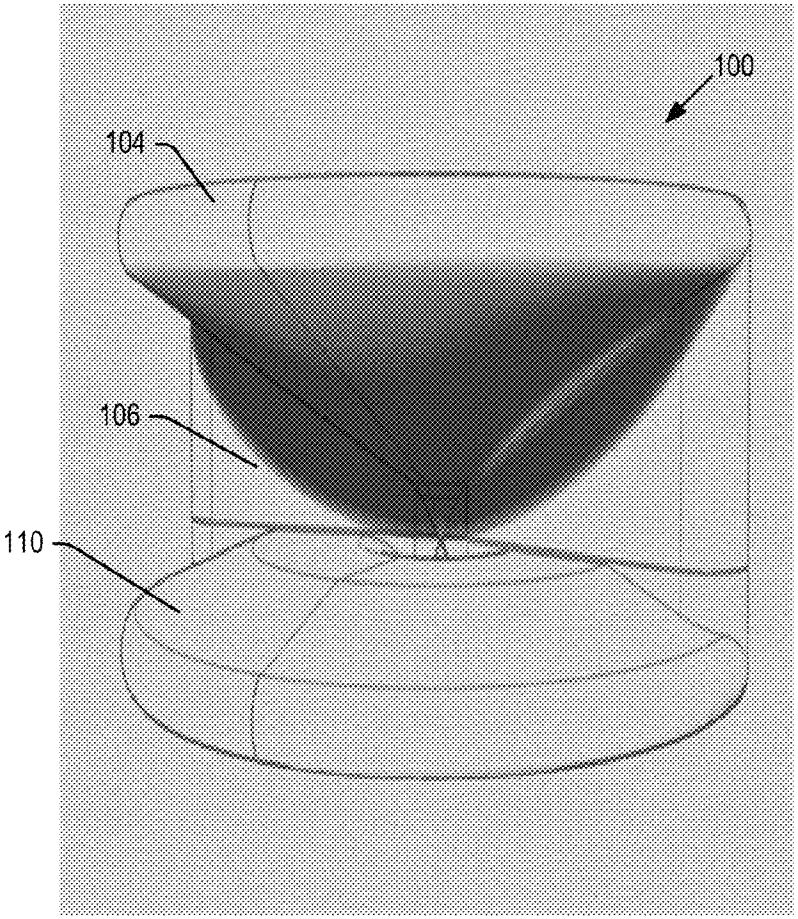

One consequence of using an expanding spherical acoustic wave model is to remove the rigid geometric constraints on the surfaces within the horn with respect to each other. Thus, it is a further feature of the present technology that the aspect ratio of the top portion 104, back portion 106 and bottom portion 110 may all vary with respect to each other. Two such examples of horns 100 having different aspect ratios are shown in FIGS. 9 and 10. Providing different aspect ratios to the different components may result in optimization of horn 100 for different applications. These different applications may include optimization for particular frequency ranges, the extent of directivity control, and optimization for transducers of varying design for which horn 100 is used.

It is a further feature of the present technology that the different surfaces within the horn 100, such as for example any or all of the above-described surfaces of top portion 104, back portion 106 and bottom portion 110 may vary proportionately or disproportionately with respect to each other for different applications. Applications where horn 100 is used for a listening audience, spaced over a relatively small horizontal distance, may have a first configuration optimized to have a relatively narrow horizontal directivity range. And applications where horn 100 is used for a listening audience, spaced over a relatively broad horizontal distance, may have a second configuration optimized to have a relatively broad horizontal directivity range. Similarly, the above described surfaces may be varied to optimize for the desired purpose in the vertical plane while otherwise keeping the horizontal directivity constant.

In summary, the present technology relates to an acoustical horn, comprising: a top portion including at least a first surface; and a bottom portion including at least a second surface, the first and second surfaces configured for the purpose of redirecting spherical waves received from a transducer to an environment in which the acoustical horn is located.

In another example, the present technology relates to an acoustical horn, comprising: a throat for receiving acoustic energy from a transducer; a top portion including a first surface and a second surface, the first surface being adjacent the throat and the second surface extending at an oblique angle from the first surface; and a bottom portion including a plurality of surfaces extending from the throat to a mouth of the horn at an outer perimeter of the horn, the top and bottom portions being asymmetrically shaped with respect to each other.

In a further example, the present technology relates to an acoustical horn having an axis of rotation, comprising: a throat for receiving acoustic energy from a transducer; a top portion including a first surface and a second surface, the second surface extending from the first surface and the second surface inclined at a more gradual angle than the first surface; and a bottom portion including: a first surface extending from the throat and having a flared contour, a second surface extending from the first surface and having a planar surface perpendicular to the axis of rotation, and a third surface extending from the second surface at an oblique angle, wherein upper and lower portions are configured to redirect spherical waves received from the transducer to an environment in which the acoustical horn is located.

Figure 11:
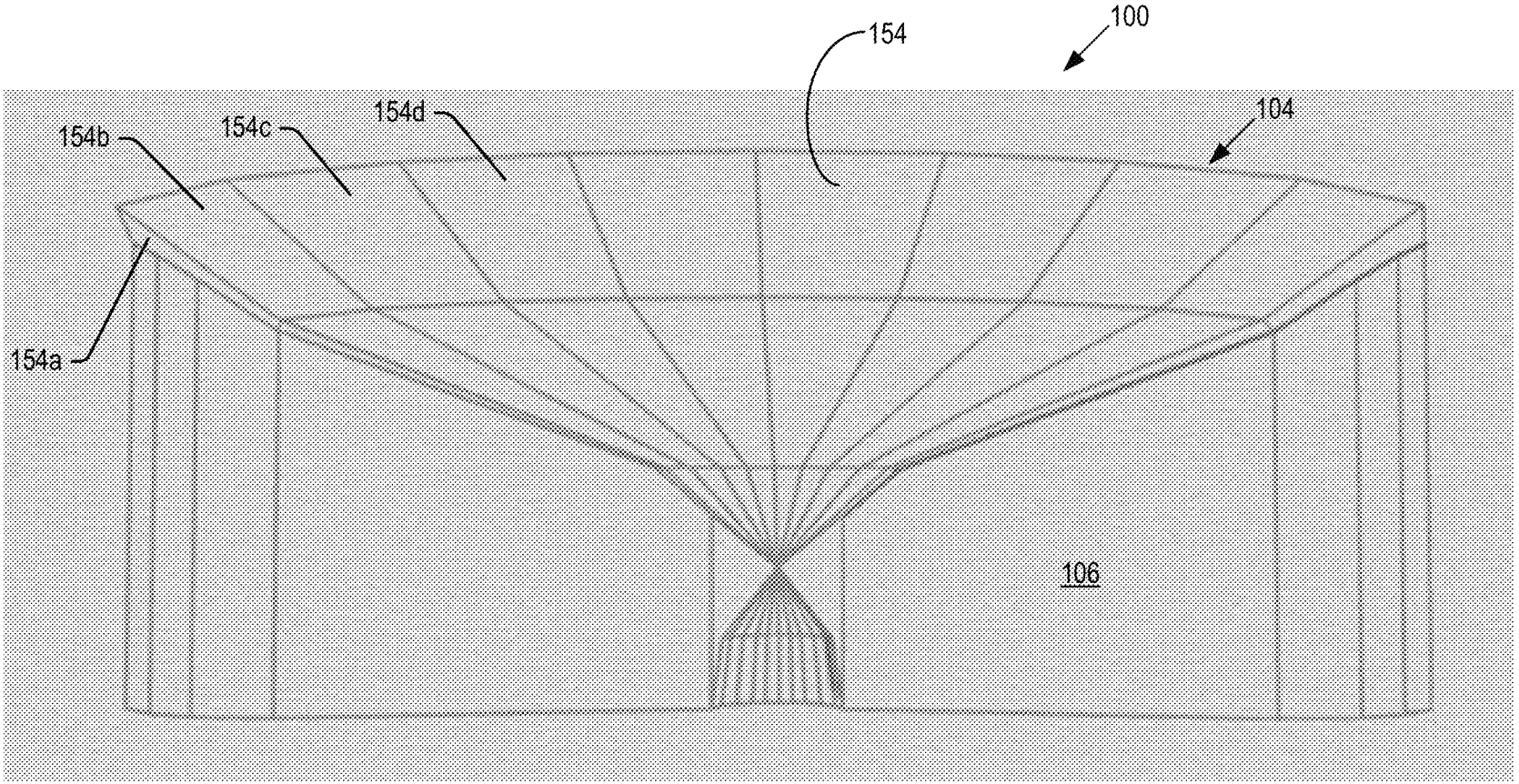
FIG. 11 is perspective view of an acoustical horn according to a further embodiment of the present disclosure.
Figure 12:
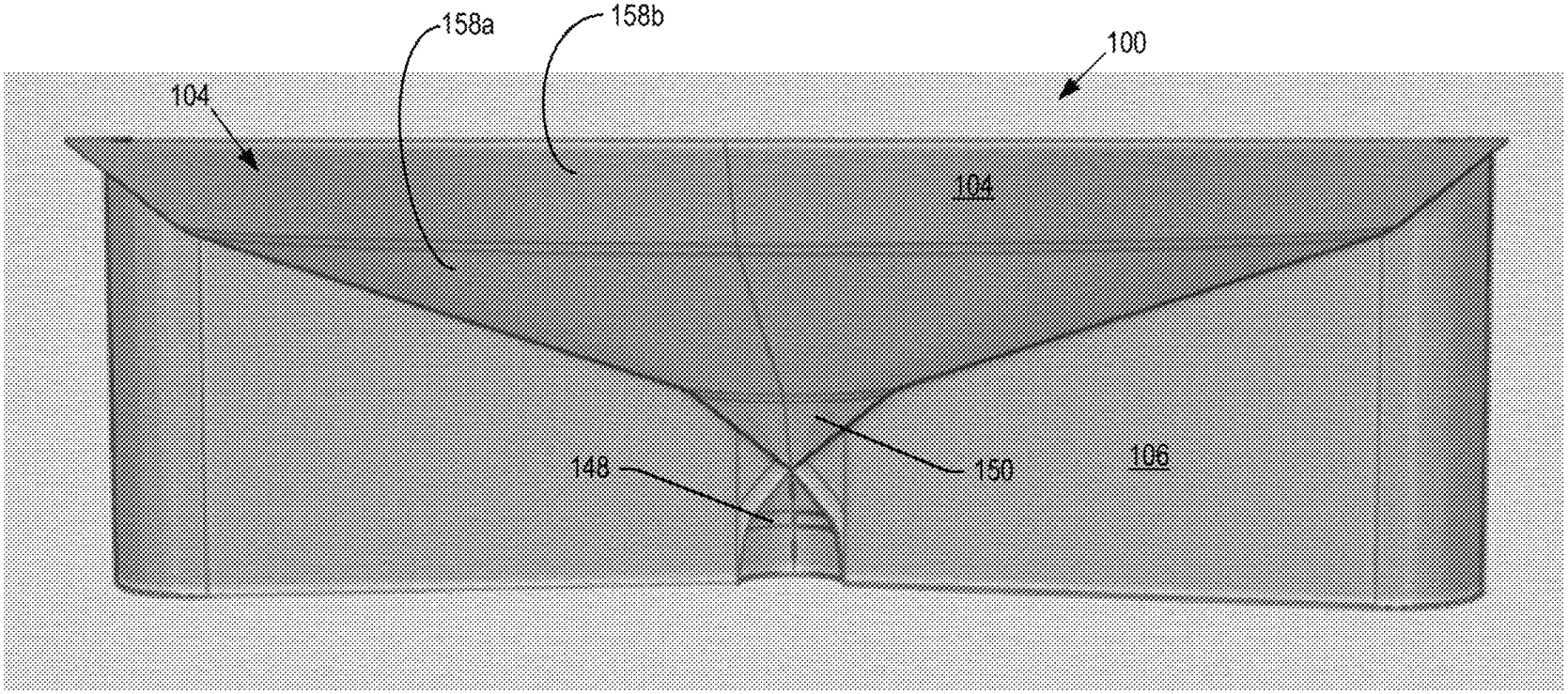
FIG. 12 is perspective view of an acoustical horn according to a still further embodiment of the present disclosure.

In embodiments described above, the conic sections defined by the top portion 104 and the bottom portion 110 are radially continuous. That is, a planar cross section through a conic surface of the top or bottom portions, perpendicular to the axis of rotation, would produce a single continuous semicircle. However, in a further embodiment, the top and/or bottom portions may be radially segmented. That is, a planar cross section through a conic surface of the top or bottom portions, perpendicular to the axis of rotation, would produce a semicircle defined by a plurality of discrete, discontinuous lines. Such an embodiment is shown in FIG. 11, where the top portion 104 is shown as segmented. The bottom portion 110 is omitted from FIG. 11, but one or both of the top and bottom portions 104, 110 could be segmented. In the embodiment of FIG. 11, the conic surface 154 is formed of a plurality of triangular segments 154*a*, 154*b*, 154*c*, etc. As shown, the size of the triangular segments need not be equal to each other, though they may be in further embodiments. In one embodiment, the triangular sections may be smaller toward the center of the horn 100, and larger at the sides (adjacent back portion 106).

In embodiments described above, the acoustical horn 100 is used to radiate acoustic power. However, in further embodiments, the horn 100 could be bi-directional. That is, acoustic waves enter into the horn 100, and are redirected to the transducer 114, which in such an embodiment, would function as a microphone. Such a horn 100 may be configured per any of the above-described embodiments. However, where bi-directional, the horn 100 could emit or receive acoustic waves. In further embodiments, the horn 100 may be uni-directional, only receiving acoustic waves for redirection to the transducer 114 functioning as a microphone.

The foregoing detailed description of the invention has been presented for purposes of illustration and description. It is not intended to be exhaustive or to limit the invention to the precise form disclosed. Many modifications and variations are possible in light of the above teaching. The described embodiments were chosen in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

We claim:

1. An acoustical horn, comprising: a top portion including at least a first conic surface; and a bottom portion defined by a plurality of discontinuous line segments revolved to generate a plurality of differentiated conic surfaces, the first surface of the top portion and the plurality of differentiated conic surfaces of the bottom portion configured for the purpose of redirecting spherical waves received from a transducer into an environment in which the acoustical horn is located, the transducer being substantially orthogonal to the radiated acoustical output; and further comprising a back portion extending between the top and bottom portions, the back portion having an arc length of between 140° and 180°.

2. The acoustical horn of claim 1, wherein the top and bottom portions are symmetrically-shaped with respect to each other.

3. The acoustical horn of claim 1, wherein the plurality of differentiated conic surfaces comprise four differentiated conic surfaces.

4. The acoustical horn of claim 1, further comprising a throat positioned adjacent the transducer, the top portion including the first surface adjacent the throat and a second surface extending at an oblique angle from the first surface.

5. The acoustical horn of claim 4, wherein the first surface includes a concave conical section and a convex conical section.

6. The acoustical horn of claim 1, further comprising a mouth at an outer perimeter of the horn, surfaces at the mouth of the horn including a curved lip.

7. An acoustical horn, comprising:

a top portion including at least a first conic surface; and a bottom portion defined by a plurality of discontinuous line segments revolved to generate a plurality of differentiated conic surfaces, the first surface of the top portion and the plurality of differentiated conic surfaces of the bottom portion configured for the purpose of redirecting spherical waves received from a transducer into an environment in which the acoustical horn is located, the transducer being substantially orthogonal to the radiated acoustical output;

wherein one conic surface of the first conic surface of the top portion and the plurality of differentiated conic surfaces of the bottom portion are radially continuous.

8. An acoustical horn, comprising:

a top portion including at least a first conic surface; and a bottom portion defined by a plurality of discontinuous line segments revolved to generate a plurality of differentiated conic surfaces, the first surface of the top portion and the plurality of differentiated conic surfaces of the bottom portion configured for the purpose of redirecting spherical waves received from a transducer into an environment in which the acoustical horn is located, the transducer being substantially orthogonal to the radiated acoustical output;

wherein one conic surface of the first conic surface of the top portion and the plurality of differentiated conic surfaces of the bottom portion are radially segmented.

9. An acoustical horn, comprising: a throat for receiving acoustic energy from a transducer; a top portion including a first surface and a second surface, the first surface being adjacent the throat and the second surface extending at an oblique angle from the first surface; and a bottom portion including a plurality of discontinuous conical surfaces extending from the throat to a mouth of the horn at an outer perimeter of the horn, the top and bottom portions being asymmetrically shaped with respect to each other; and further comprising a back portion extending between the top and bottom portions, the back portion including: a first surface, a line perpendicular to the first surface bisecting the acoustical horn into equal, semicircular halves, a second surface extending from a first side of the first surface at an oblique angle, and a third surface extending from a second side of the first surface at an oblique angle.

10. The acoustical horn of claim 9, wherein the upper and lower portions are configured to redirect spherical waves received from the transducer to an environment in which the acoustical horn is located.

11. The acoustical horn of claim 9, wherein the second surface extends from the first surface at an angle of between 10° and 20°.

12. The acoustical horn of claim 11, wherein the third surface extends from the first surface at an angle of between 10° and 20°.

13. The acoustical horn of claim 9, wherein outermost portions of the second and third surfaces end in a curled lip.

14. The acoustical horn of claim 9, wherein an outermost section of the second surface of the top portion ends in a curled lip.

15. The acoustical horn of claim 9, wherein an outermost surface of the bottom portion ends in a curled lip.

16. An acoustical horn having an axis of rotation, comprising: a throat for receiving acoustic energy from a transducer; a top portion including a first surface and a second surface, the second surface extending from the first surface and the second surface inclined at a more gradual angle than the first surface; and a bottom portion including: a first surface extending from the throat and having a flared contour, a second surface extending from the first surface and having a planar surface perpendicular to the axis of rotation, and a third surface extending from the second surface at an oblique angle, wherein upper and lower portions are configured to redirect spherical waves received from the transducer to an environment in which the acoustical horn is located and further comprising a back portion extending between the top and bottom portions, the back portion having an arc length of between 140° and 160°.

17. The acoustical horn of claim 16, further comprising a curled lip extending from an outer edge of the second surface of the top portion.

18. The acoustical horn of claim 16, further comprising a curled lip extending from an outer edge of the third surface of the bottom portion.

19. An acoustical horn having an axis of rotation, comprising:

a throat for receiving acoustic energy from a transducer;

a top portion including a first surface and a second surface, the second surface extending from the first surface and the second surface inclined at a more gradual angle than the first surface; and a bottom portion including:

a first surface extending from the throat and having a flared contour, a second surface extending from the first surface and having a planar surface perpendicular to the axis of rotation, and a third surface extending from the second surface at an oblique angle, wherein upper and lower portions are configured to redirect spherical waves received from the transducer to an environment in which the acoustical horn is located;

wherein the first surface of the top portion includes a concave conical section and a convex conical section.

20. The acoustical horn of claim 19, further comprising a back portion, including:

a first surface residing in a plane bisecting the concave conical section and the convex conical section, a line perpendicular to the first surface bisecting the acoustical horn into equal, semicircular halves, a second surface extending from a first side of the first surface at an oblique angle, and a third surface extending from a second side of the first surface at an oblique angle.

21. An acoustical horn, comprising:

a top portion including at least a first conic surface; and a bottom portion defined by a plurality of discontinuous line segments revolved to generate a plurality of differentiated conic surfaces, the first surface of the top portion and the plurality of differentiated conic surfaces of the bottom portion configured for the purpose of redirecting spherical waves orthogonally into an environment in which the acoustical horn is located;

wherein the plurality of differentiated conic surfaces comprise four differentiated conic surfaces.

22. An acoustical horn, comprising:

a top portion including at least a first conic surface; and a bottom portion defined by a plurality of discontinuous line segments revolved to generate a plurality of differentiated conic surfaces, the first surface of the top portion and the plurality of differentiated conic surfaces of the bottom portion configured for the purpose of redirecting spherical waves orthogonally into an environment in which the acoustical horn is located;

wherein the top and bottom portions are asymmetrically-shaped with respect to each other.

23. An acoustical horn, comprising: a top portion including at least a first conic surface; and a bottom portion defined by a plurality of discontinuous line segments revolved to generate a plurality of differentiated conic surfaces, the first surface of the top portion and the plurality of differentiated conic surfaces of the bottom portion configured for the purpose of redirecting spherical waves orthogonally into an environment in which the acoustical horn is located; and further comprising a back portion extending between the top and bottom portions, the back portion having an arc length of between 140° and 160°.

24. An acoustical horn, comprising:

a top portion including at least a first conic surface; and a bottom portion defined by a plurality of discontinuous line segments revolved to generate a plurality of differentiated conic surfaces, the first surface of the top portion and the plurality of differentiated conic surfaces of the bottom portion configured for the purpose of redirecting spherical waves orthogonally into an environment in which the acoustical horn is located;

further comprising a throat positioned adjacent the transducer, the top portion including the first surface adjacent the throat and a second surface extending at an oblique angle from the first surface;

wherein the first surface includes a concave conical section and a convex conical section.

25. An acoustical horn, comprising:

a top portion including at least a first conic surface; and a bottom portion defined by a plurality of discontinuous line segments revolved to generate a plurality of differentiated conic surfaces, the first surface of the top portion and the plurality of differentiated conic surfaces of the bottom portion configured for the purpose of redirecting acoustic waves toward a transducer from an environment in which the acoustical horn is located, the transducer being substantially orthogonal to the received acoustical input;

wherein the plurality of differentiated conic surfaces comprise four differentiated conic surfaces.

* * * * *